US008681471B2

(12) United States Patent
Fukada

(10) Patent No.: US 8,681,471 B2
(45) Date of Patent: Mar. 25, 2014

(54) ION GENERATOR

(75) Inventor: Yoshinari Fukada, Tokyo (JP)

(73) Assignee: Koganei Corporation, Tokyo (JP)

( * ) Notice: Subject to any disclaimer, the term of this patent is extended or adjusted under 35 U.S.C. 154(b) by 0 days.

(21) Appl. No.: 13/819,930

(22) PCT Filed: Apr. 14, 2011

(86) PCT No.: PCT/JP2011/059289

§ 371 (c)(1),
(2), (4) Date: Feb. 28, 2013

(87) PCT Pub. No.: WO2012/029349

PCT Pub. Date: Mar. 8, 2012

(65) Prior Publication Data

US 2013/0161512 A1 Jun. 27, 2013

(30) Foreign Application Priority Data

Sep. 1, 2010 (JP) ..... 2010-195513

(51) Int. Cl.

*H01H 47/00* (2006.01)
*H01T 23/00* (2006.01)
*H01J 27/00* (2006.01)

(52) U.S. Cl.

USPC ..... 361/220; 361/231; 250/424; 250/426

(58) Field of Classification Search

USPC ..... 361/220; 250/324
See application file for complete search history.

(56) References Cited

U.S. PATENT DOCUMENTS

| | | | | |
|---|---|---|---|---|
| 5,121,286 | A * | 6/1992 | Collins | 361/231 |
| 5,550,703 | A * | 8/1996 | Beyer et al. | 361/229 |
| 6,646,257 | B1 * | 11/2003 | Fischer et al. | 250/288 |
| 7,199,364 | B2 * | 4/2007 | Thakur | 250/288 |
| 7,375,945 | B2 * | 5/2008 | Izumi et al. | 361/231 |
| 7,408,562 | B2 * | 8/2008 | Kotsuji | 347/123 |

(Continued)

FOREIGN PATENT DOCUMENTS

JP 2000138090 A 5/2000

(Continued)

OTHER PUBLICATIONS

International Search Report for PCT/JP2011/059289 dated Jul. 12, 2011.

*Primary Examiner* — Jack Berman
*Assistant Examiner* — Sean Luck
(74) *Attorney, Agent, or Firm* — McCormick, Paulding & Huber LLP

(57) ABSTRACT

An ion generator 10*a* has an ejection head 18 as an opposite electrode and a discharge electrode 16, and generates air ions by corona discharge. A nozzle 14 supporting the discharge electrode 16 is attached to a base member 12 formed with an air supply path 11, and the nozzle 14 is formed with an exposure surface 24 for exposing the tip end portion 16*b* of the discharge electrode 16 and a tapered surface 25. The nozzle 14 is formed with air guide holes 26 which communicate with the air supply path 11, and ejection ports of the air guide holes 26 are open on the tapered surface 25. Compressed air ejected from the ejection port is flowed along the tapered surface 25 so that outside air surrounding the nozzle 14 is involved in the compressed air, and sprayed in a front direction of the discharge electrode 16.

18 Claims, 7 Drawing Sheets

(56) References Cited

U.S. PATENT DOCUMENTS

| | | | | |
|---|---|---|---|---|
| 8,039,795 | B2 * | 10/2011 | Mordehai et al. | 250/288 |
| 8,355,237 | B2 * | 1/2013 | Kotsuji et al. | 361/230 |
| 8,530,832 | B2 * | 9/2013 | Mordehai et al. | 250/288 |
| 2006/0193100 | A1 * | 8/2006 | Izaki et al. | 361/220 |
| 2010/0044581 | A1 * | 2/2010 | Fujita et al. | 250/424 |

FOREIGN PATENT DOCUMENTS

| | | | |
|---|---|---|---|
| JP | 2004228069 | A | 8/2004 |
| JP | 2006040860 | A | 2/2006 |
| JP | 2007242568 | A | 9/2007 |
| WO | 2006112020 | A1 | 10/2006 |

* cited by examiner

ION GENERATOR

CROSS REFERENCE TO RELATED APPLICATIONS

This application claims the priority of PCT Application No. PCT/JP2011/059289, filed on Apr. 14, 2011 and Japanese Patent Application No. 2010-195513 filed on Sep. 1, 2010, the disclosures of which are incorporated herein by reference in their entirety.

BACKGROUND OF THE INVENTION

1. Technical Field

The present invention relates to an ion generator in which air ionized by corona discharge is sprayed to an object required to be electrically neutralized.

2. Prior Art

To spray air ions to an electrically-charged body as an object required to be electrically neutralized and to electrically neutralize the object, an ion generator which is also referred to as "ionizer" or "charge neutralization apparatus" is used. In a manufacturing line for manufacturing and assembling electronic components, the ion generator is used for removing static electricity from the electronic components, manufacturing and assembling jigs and the like as the object. By spraying air ions to the object, foreign substances can be prevented from being attached to the electronic components and the like by the static electricity, and the electronic components can be prevented from being broken or attached to the jigs by the static electricity.

The ion generator used for a purpose such as this, as explained in Patent Japanese Patent Publication No. 2000-138090, Japanese Patent Publication No. 2004-228069, and Japanese Patent Publication No. 2006-40860, ionizes air by applying an alternating voltage between a discharge electrode and an opposite electrode and generating corona discharge around the discharge electrode with compressed air being supplied to the discharge electrode from outside.

In an ion generator described in Japanese Patent Publication No. 2000-138090, air ions ejected from an air ejection port of a housing provided with a discharge electrode are supplied via a duct to the object which is arranged at a position away from the ion generator. In the ion generator described in Japanese Patent Publication No. 2004-228069 and Japanese Patent No. 2006-40860, air ions are sprayed directly to the object from a nozzle provided with a discharge electrode.

SUMMARY OF THE INVENTION

Problems to be Solved by the Invention

In the ion generator described in Japanese Patent Publication No 2000-138090 and Japanese Patent Publication No. 2004-228069, air supplied to the housing from an air supply source is ionized, and only that ionized air is sprayed to the object. In the ion generator described in Japanese Patent No. 2006-40860, in addition to air to be supplied to the nozzle from the air supply source, ionized, and then ejected from an ejection port, with outside air being involved by the flow of the air to be ejected from the ejection port, air ions are sprayed to the object. Thus, by involving outside air in the flow of air ions ejected from the ejection port, air ions more than the amount of compressed air supplied from the air compression source can be sprayed to the object, and it is possible to enhance a static elimination effect.

In order to increase the amount of outside air to be introduced by the flow of air ions ejected from the ejection port, it is necessary to increase the flow rate or pressure of compressed air to be supplied to the nozzle from the air supply source. By increasing the flow rate or pressure of compressed air, the consumed amount of energy for air supply is increased. For this reason, in order to efficiently generate air ions, it is required to involve outside air in air ejected to the nozzle from the air compression source without increasing the amount of compressed air to be supplied to the nozzle from the air supply source.

An object of the present invention is to enhance a static elimination effect of an ion generator by involving a large amount of outside air.

Means for Solving the Problems

An ion generator according to the present invention has a discharge electrode and an opposite electrode provided in the vicinity of the discharge electrode, and generates air ions by applying an alternating high voltage between the electrodes to generate corona discharge, wherein the ion generator has a nozzle supporting the discharge electrode, the nozzle being formed with an exposure surface for exposing a tip end portion of the discharge electrode, and a tapered surface extending to an outer peripheral surface from the exposure surface so as to be slanted in a base end portion side direction, the nozzle is formed with an air guide hole communicating with the air supply path, and an ejection port of the air guide hole is formed so as to be open on the tapered surface, outside air surrounding the nozzle is involved in air which flows along the tapered surface from the ejection port and flows in a front direction of the discharge electrode.

In the ion generator according to the present invention, an auxiliary air guide hole is formed in the nozzle, wherein air is supplied to the periphery of the discharge electrode from the auxiliary air guide hole. The ion generator according to the present invention has an ejection head which covers the nozzle, wherein the ejection head is formed with an ejection hole for ejecting air ions and an air introduction hole through which outside air is taken in. In the ion generator according to the present invention, the ejection head is made of conductive material, and the ejection head is defined as the opposite electrode.

In the ion generator according to the present invention, an air supply joint member formed with an air introduction port communicating with the air introduction hole is mounted on the ejection head, wherein the outside air is supplied to the periphery of the nozzle from the air introduction port. In the ion generator according to according to the present invention, the tip end portion of the discharge electrode is approximately on the same level the exposure surface. In the ion generator according to the present invention, the tip end portion of the discharge electrode protrudes in comparison with the exposure surface.

Effects of the Invention

According to the present invention, since the ejection port of the air guide hole is open on the tapered surface, compressed air ejected from the ejection port flows along the tapered surface. And outside air surrounding the nozzle is involved in the air flowing along the tapered surface. As a result, the air is amplified by the outside air without increasing the flow rate of compressed air to be supplied to the air guide hole by an amplified amount of outside air involved, it is possible to enhance a static elimination effect for the object.

By forming an auxiliary air guide hole in the nozzle and guiding compressed air from this auxiliary air guide hole along the discharge electrode, foreign substances can be prevented from being adhered to the tip end portion of the discharge electrode due to involution of the outside air.

Also, even if the tip end portion of the discharge electrode protrudes in comparison with the tip end surface of the nozzle, since compressed air ejected from the ejection port of the air guide hole flows along the tapered surface so as to wrap the discharge electrode, foreign substances can be prevented from being adhered to the tip end portion of the discharge electrode. Since foreign substances can be prevented from being adhered to the tip end portion of the discharge electrode, the frequency of maintenance of the discharge electrode can be decreased.

By locating the ejection head formed with an ejection hole for ejecting compressed air to be sprayed from the nozzle so that the ejection head covers the nozzle, and providing the ejection head as the opposite electrode, an ion generating chamber is formed by the ejection hole of the ejection head. Since compressed air and involved air amplified by this compressed air are supplied to the ejection hole as the ion generating chamber, it is possible to ionize the compressed air with the involved air.

BRIEF DESCRIPTIONS OF THE DRAWINGS

DESCRIPTION OF THE PREFERRED EMBODIMENTS

Hereinafter, embodiments of the present invention will be described in detail with reference to the drawings. In these embodiments, members having a commonality are denoted by the same reference numbers.

Figure 1:
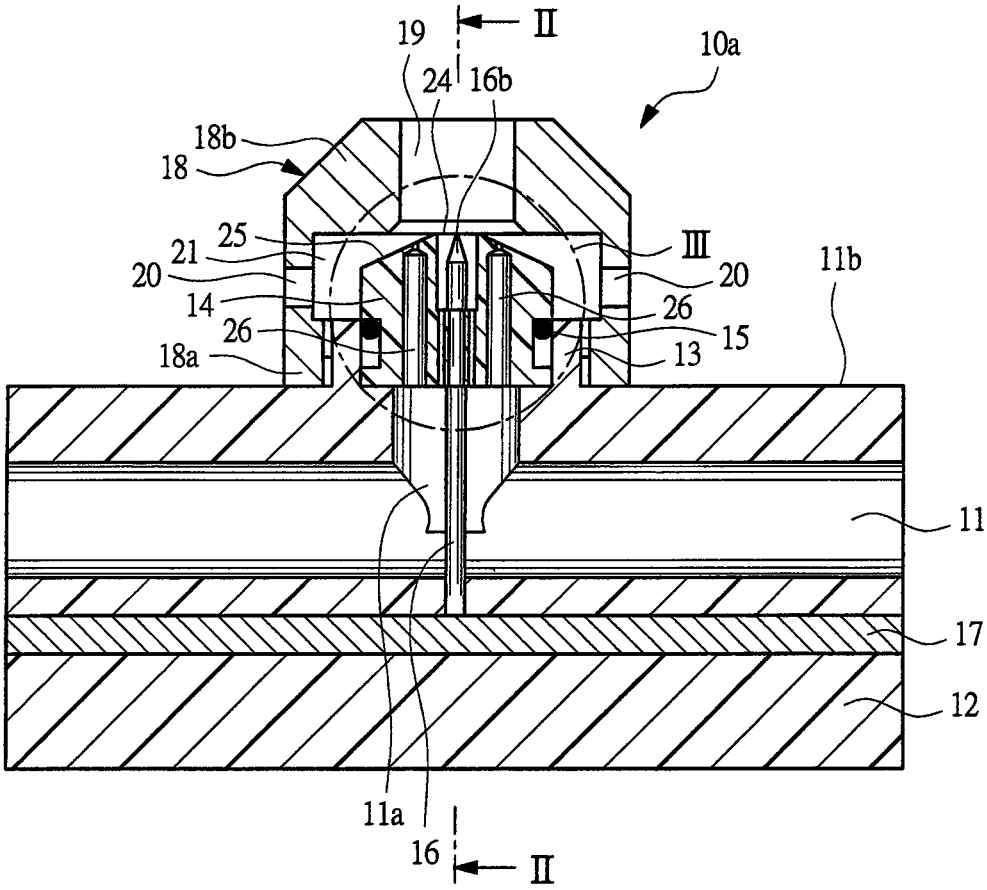
FIG. 1 is a cross sectional view showing an ion generator according one embodiment of the present invention.
Figure 2:
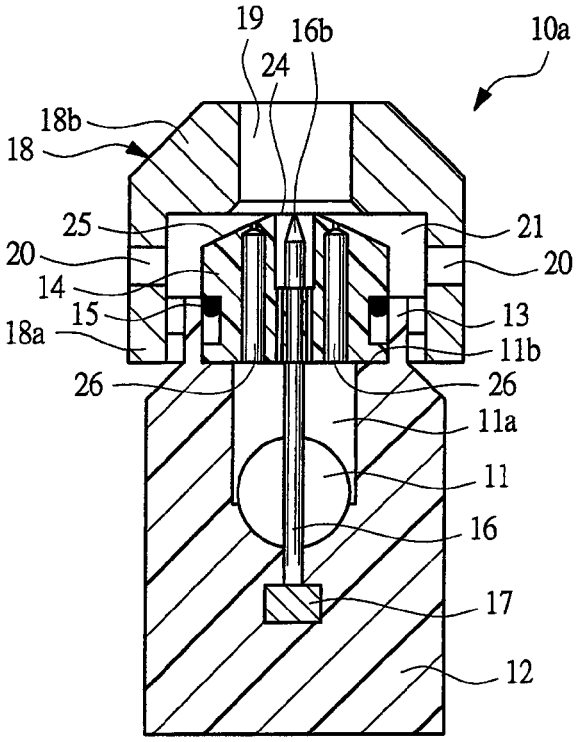
FIG. 2 is a cross sectional view taken along a line II-II in FIG. 1.
Figure 3:
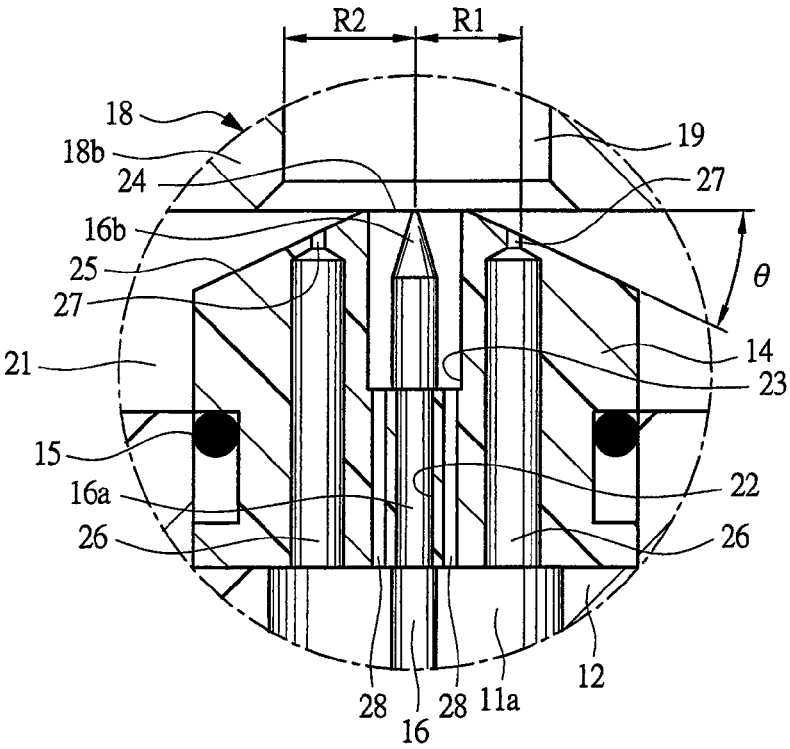
FIG. 3 is an enlarged cross sectional view showing a portion III in FIG. 1.

An ion generator 10*a* shown in FIGS. 1 to 3 has a resin-made base member 12 formed with an air supply path 11. This air supply path 11 is configured so as to be connected to an air supply source which is composed of a compressor and others (not shown) via a hose or a pipe. The base member 12 is formed with a communication hole 11*a* communicating with the air supply path 11, and the communication hole 11*a* is open on a head mount surface 11*b* of the base member 12. The base member 12 is provided with a cylindrical-shaped support cylinder 13 which corresponds to the communication hole 11*a* and which is larger in inner diameter than the communication hole 11*a*. A base end of a resin-made nozzle 14 having insulation properties is fitted in the support cylinder 13, and the nozzle 14 is mounted in the support cylinder 13. A gap between the nozzle 14 and the support cylinder 13 is sealed with a seal member 15.

A stick-shaped discharge electrode 16 is supported at the center of the nozzle 14. A high voltage supply member 17 is incorporated in the base member 12. When the nozzle 14 is inserted in the support cylinder 13, the discharge electrode 16 comes into contact with the high voltage supply member 17, so that the discharge electrode 16 is electrically connected to the high voltage supply member 17.

An ejection head 18 is mounted on the outside of the support cylinder 13. This ejection head 18 is made of conductive material, and serves as an opposite electrode arranged in the vicinity of the discharge electrode 16. A high voltage supply member (not shown) is connected to the ejection head 18, and when an alternating high voltage is applied between the discharge electrode 16 and the ejection head 18, corona discharge is generated around the tip end portion of the discharge electrode 16, thereby ionizing surrounding air.

The ejection head 18 has a cylindrical portion 18*a* into which the support cylinder 13 is fitted, and a tip end wall portion 18*b* integrated with a tip end of this portion. The tip end wall portion 18*b* is formed with an ejection hole 19 for ejecting ionized air ions, and the cylindrical portion 18*a* is formed with air introduction holes 20 which communicate with an air amplifying chamber 21 formed in the cylindrical portion 18*a*, and outside air is supplied to the air amplifying chamber 21 via the air introduction holes 20.

In the base member 12 shown in FIG. 1, only one ejection head 18 is provided, however, by mounting a plurality of ejection heads 18 on the base member 12 at regular intervals along its longitudinal direction, an ion generator provided with a plurality of discharge electrodes 16 may be made. Any number of the nozzles 14 may be mounted on the base member 12. In FIG. 1, one end of the air supply path 11 is closed, and the other end is connected to a hose or a pipe for supplying air.

As shown in FIG. 3, the discharge electrode 16 is formed with a small-diameter portion 16*a*, and the small-diameter portion 16*a* is fitted in a mounting hole 22 formed in the nozzle 14. Step portions formed at both ends of the small-diameter portion 16*a* abut on a radial surface of the nozzle 14 to set a position of the discharge electrode 16 in an axial direction with respect to the nozzle 14. The nozzle 14 is formed with an accommodation hole 23 larger in diameter than the mounting hole 22, and this accommodation hole 23 has a tip end which is open on an exposure surface 24 formed in a radial direction at the center of a tip end surface of the nozzle 14. The tip end portion of the discharge electrode 16 is approximately on the same level with the exposure surface 24. With this exposure surface 24, a tip end portion 16*b* of the discharge electrode 16 is exposed on the outside of the nozzle 14.

On the tip end surface of the nozzle 14, a tapered surface 25 extending to an outer peripheral surface of the nozzle 14 from an outer circumferential edge of the exposure surface so as to be slanted in a base end portion side direction is formed. The tapered surface 25 has a tilt angle 0 of approximately 25 degrees. The nozzle 14 is formed with air guide holes 26 communicating with the air supply path 11 via the communication hole 11*a*. One end of each air guide hole 26 communicates with the air supply path 11 via the communication hole 11*a*, and the other end is open on the tapered surface 25. An opening formed on the tapered surface 25 as one end of each air guide hole 26 serves as an ejection port 27 for ejecting air supplied from the air supply path 11 in a front direction of the nozzle 14. The ejection port 27 is smaller in inner diameter than the air guide hole 26, and air flowing into the air guide hole 26 from the air supply path 11 via the communication hole 11*a* is focused and then ejected in the front direction of the nozzle 14.

In addition to the air guide holes 26, in the nozzle 14, auxiliary air guide holes 28 are formed between the air guide holes 26 and the discharge electrode 16. Base end side openings of the auxiliary air guide holes 28 communicate with the air supply path 11 via the communication hole 11*a*, and tip end side openings face the exposure surface 24 at the tip end of the nozzle 14. Therefore, air flowed from the air supply path 11 via the communication hole 11*a* into the auxiliary air guide holes 28 flows along the discharge electrode 16 in the accommodation hole 23 and ejected from the exposure surface 24 in the front direction of the nozzle 14. In this way, air ejected from the auxiliary air guide holes 28 flows along the discharge electrode 16.

Four air guide holes 26 are formed, and of the total, two are formed in a cross-section taken along a longitudinal direction of the base member 12 as shown in FIG. 1, and two are formed in a cross-section taken along a lateral direction of the base member 12 as shown in FIG. 2. Similarly, four air introduction holes 20 are formed so as to correspond to the air guide holes 26. However, the number of the air introduction holes 20 and the number of air guide holes 26 are each not restricted to four, and any number may be set. A radial distance "R1" between the far side of an inner circumferential surface of each ejection port 27 and the discharge electrode 16 is set to be smaller than the radius "R2" of the ejection hole 19 as shown in FIG. 3. Air ejected from each ejection port 27 is released into the outside via the ejection hole 19.

Some of air ejected from each ejection port 27 flows, without going straight, so as to be diffused along the tapered surface 25, and flows in the front direction of the discharge electrode 16. Since this air flow becomes an air flow heading for the center in the radial direction, this air flow has a property of involving outside air surrounding the nozzle 14 in the air amplifying chamber 21. Thus, air in the air amplifying chamber 21 is involved in the air flow diffusing in the front direction of the discharge electrode 16. Outside (surrounding) air involved from the air introduction holes 20 does not come into contact with the discharge electrode 16 and its tip end portion 16*b*. Therefore, foreign substances in the outside air are not adhered to the tip end portion 16*b*.

Thus, since by forming the ejection ports 27 in the tapered surface 25, outside air is suctioned by the air flow diffusing along the tapered surface 25 and then flowing in the front direction of the discharge electrode 16, it is possible to supply a large amount of air to the ejection hole 19 without increasing the flow rate or pressure of compressed air to be supplied to the air supply path 11. The tilt angle θ of the tapered surface 25 is not restricted to 25 degrees described above. If the tilt angle θ is set to be equal to or lager than 20 degrees, compressed air ejected from the ejection ports 27 can be diffused along the tapered surface 25 and oriented in the front direction of the discharge electrode 16.

To the ejection hole 19 of the ejection head 18, outside air suctioned by compressed air from the air guide holes 26 and the auxiliary air guide holes 28 and compressed air from the ejection ports 27 of the air guide holes 26 are sprayed. Thus, air ejected into the ejection hole 19 is ionized in the ejection hole 19 by corona discharge generated around the tip end portion 16*b* of the discharge electrode 16. In this way, the ejection hole 19 forms an ion generating chamber for ionizing air including amplified air and passing through the ejection hole 19.

Figure 4:
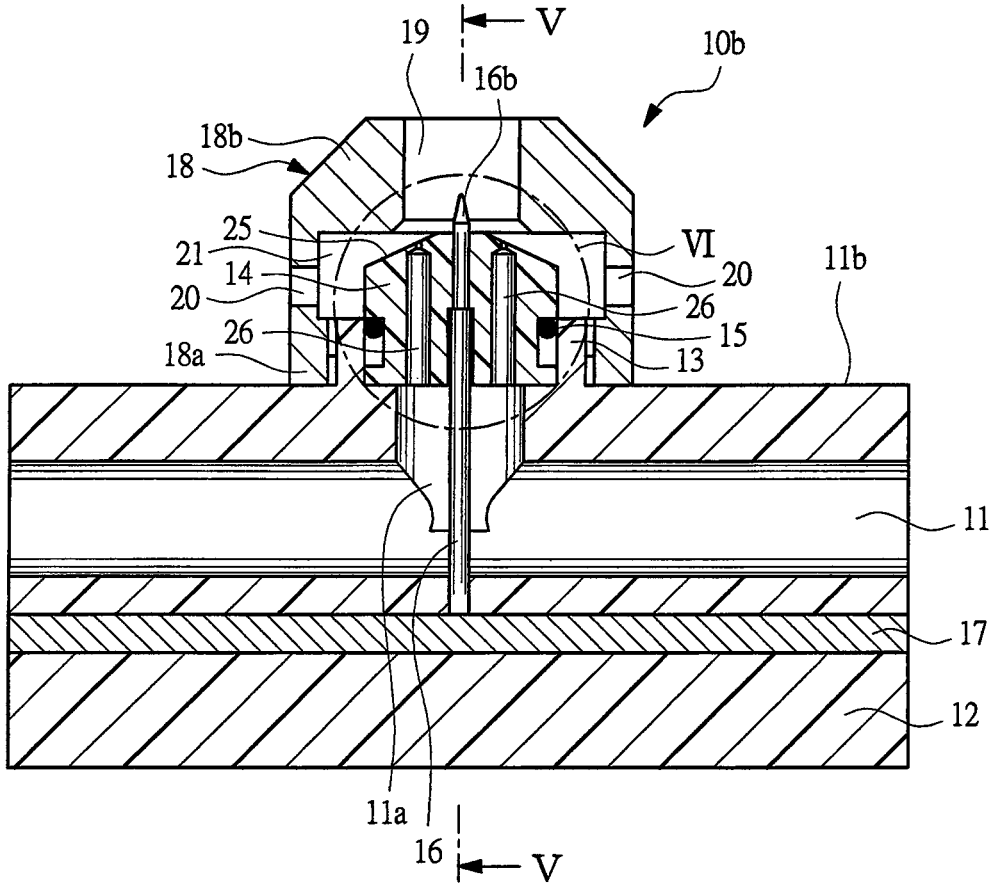
FIG. 4 is a cross sectional view showing an ion generator according another embodiment of the present invention.
Figure 5:
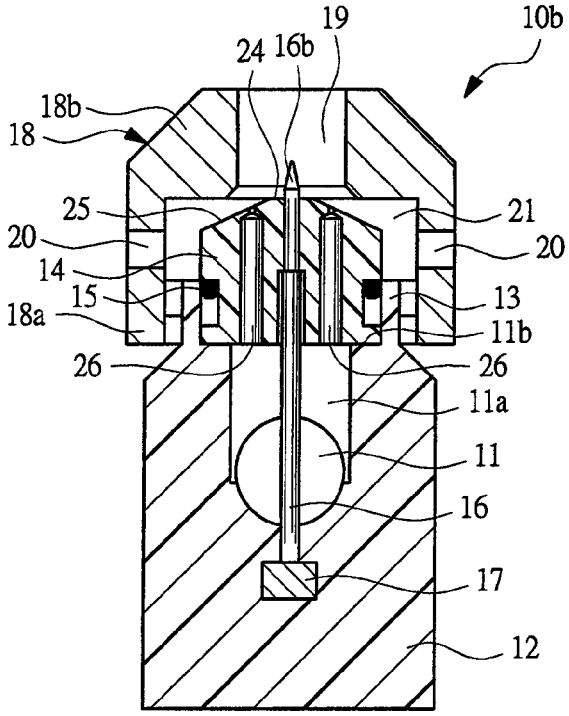
FIG. 5 is a cross sectional view taken along a line V-V in FIG. 4.
Figure 6:
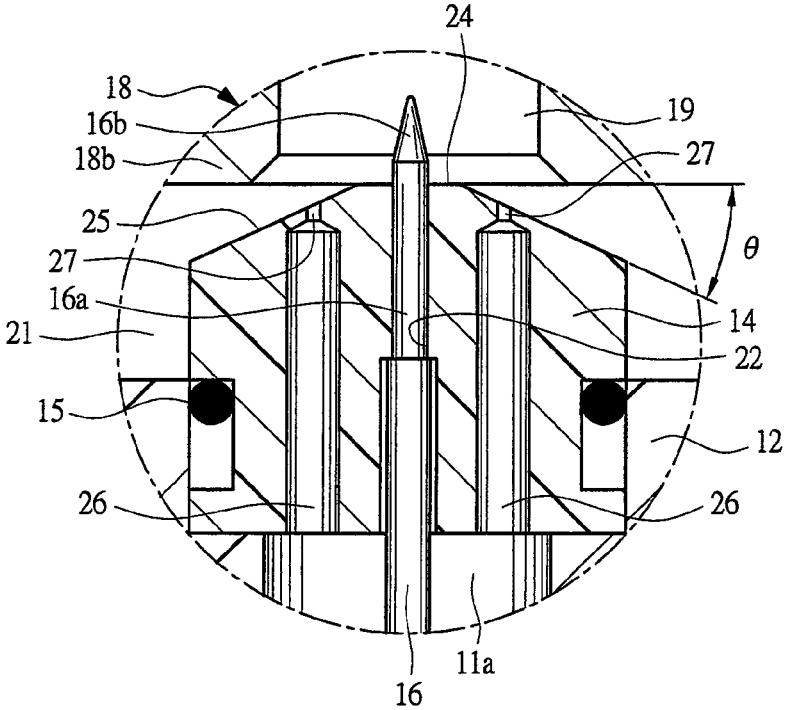
FIG. 6 is an enlarged cross sectional view showing a portion VI in FIG. 4.

In an ion generator 10*b* shown in FIGS. 4 to 6, the tip end portion 16*b* of the discharge electrode 16 protrudes forwardly in comparison with the exposure surface 24 of the nozzle 14, and auxiliary air guide holes 28 in the ion generator 10*a* shown in FIGS. 1 to 3 are not provided to the nozzle 14. Since the tip end portion 16*b* of the discharge electrode 16 protrudes forwardly in comparison with the exposure surface 24 extending in the radial direction, compressed air ejected from the ejection ports 27 of the air guide holes 26 and diffused along the tapered surface 25 flows along the tip end portion 16*b* of the discharge electrode 16, thereby preventing foreign substances from being adhered to the tip end portion 16*b* of the discharge electrode 16.

Also in the ion generator 10*b* shown in FIGS. 4 to 6, air ejected from each ejection port 27 is diffused along the tapered surface 25 and flows in the front direction of the discharge electrode 16. In this manner, air surrounding the nozzle 14 in the air amplifying chamber 21 of the ejection head 18 is involved in air flow diffusing in the front direction of the discharge electrode 16 to be suctioned. Therefore, a large amount of air can be supplied toward the ejection hole 19 without increasing a flow rate or pressure of the compressed air to be supplied to the air supply path 11. Air flowing into the inside of the ejection hole 19 is ionized inside the ejection hole 19 having a function as an ion generating chamber.

Figure 7:
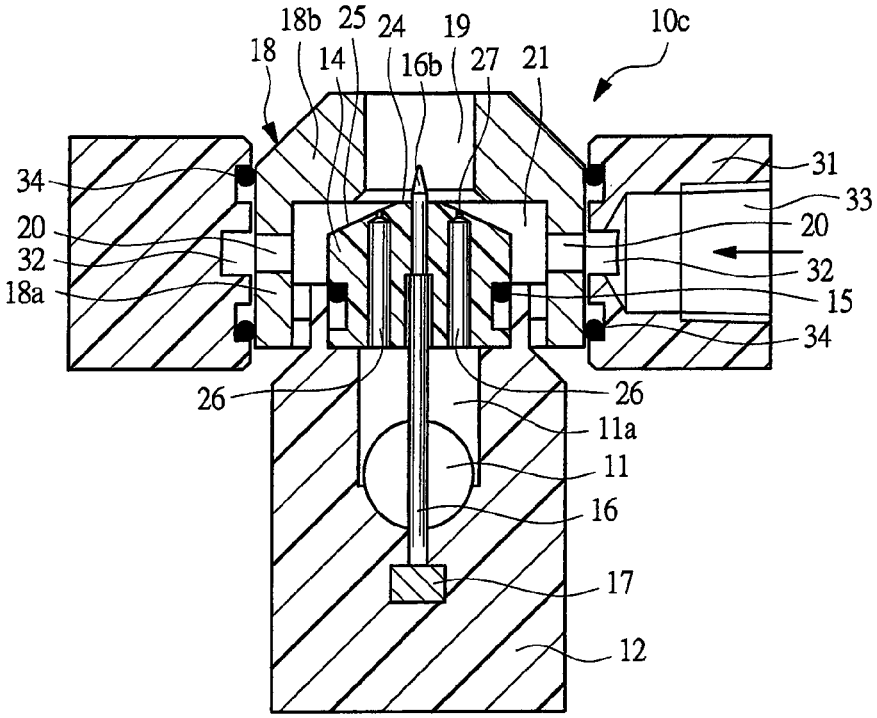
FIG. 7 is a cross sectional view of an ion generator in which the effect of the present invention is measured.

An ion generator 10*c* shown in FIG. 7 is the same in basic structure as the ion generator 10*b* shown in FIGS. 4 to 6. In the ion generator 10*c*, a ring-shaped air supply joint member 31 is mounted on the outside of the cylindrical portion 18*a* of the ejection head 18. A ring-shaped communication groove 32 is formed on an inner circumferential surface of the air supply joint member 31 so as to correspond to the air introduction holes 20, and the air supply joint member 31 is formed with an air introduction port 33 communicating with the communication groove 32. The introduction port 33 is connected to hose or pipe for guiding outside air. By cleaning outside air which is supplied to the air introduction port 33 by a filter, clean air not containing foreign substances can be supplied from the air introduction holes 20 to the air amplifying chamber 21. Seal members 34 for sealing a gap between the air supply joint member 31 and the ejection head 18 are mounted on both sides of the communication groove 32.

In each of the ion generators 10*a* to 10*c* described above, the ejection ports 27 are open on the tapered surface 25 formed at the tip end of the nozzle 14. Therefore, since some of compressed air ejected from the ejection ports 27 flows along the tapered surface 25 by diffusion, without going straight on in its front direction, it becomes air flow heading for the center in a direction in which outside air surrounding the nozzle 14 in the air amplifying chamber 21 is involved. Therefore, the ejected compressed air suctions a large amount of outside air, and the large amount of outside air is involved in the ejected air to be supplied to the ejection hole 19.

Figure 8:
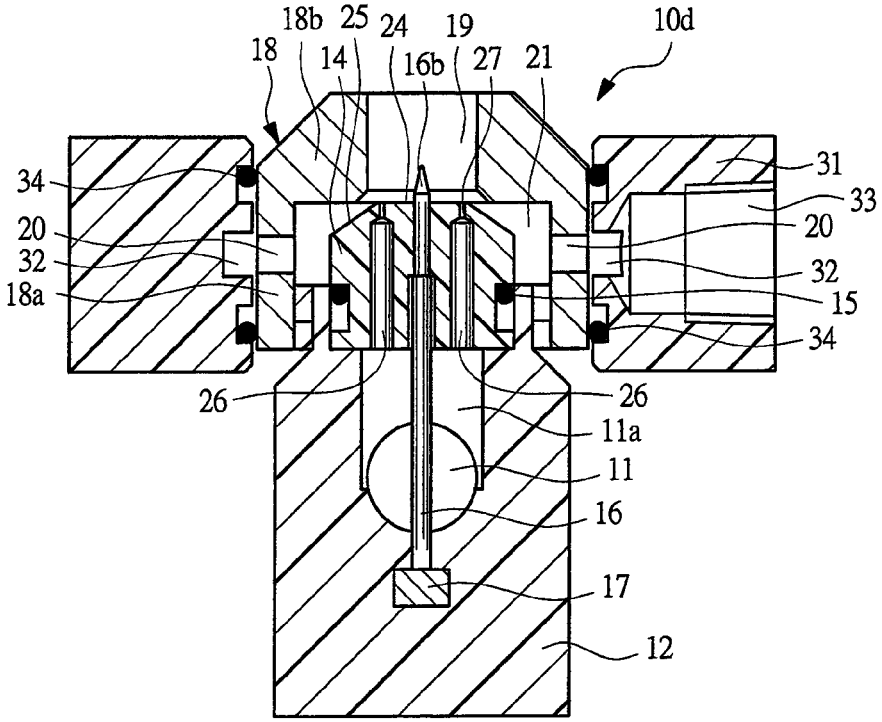
FIG. 8 is a cross sectional view showing an ion generator as an example for comparison.

FIG. 8 shows an ion generator 10*d* as an example for comparison. In this case, the ejection ports 27 of the air guide holes 26 are open on the exposure surface 24 extending in a radial direction, and other structures are similar to those of the ion generator 10*c* shown in FIG. 7.

Figure 9:
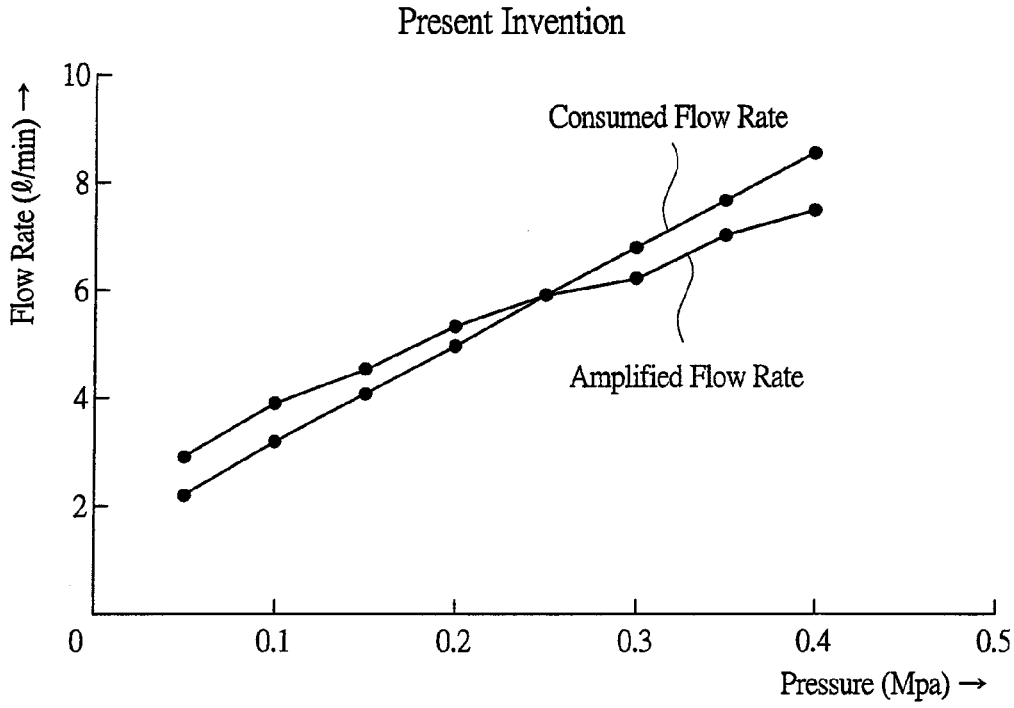
FIG. 9 is a flow rate diagram of the ion generator shown in FIG. 7.
Figure 10:
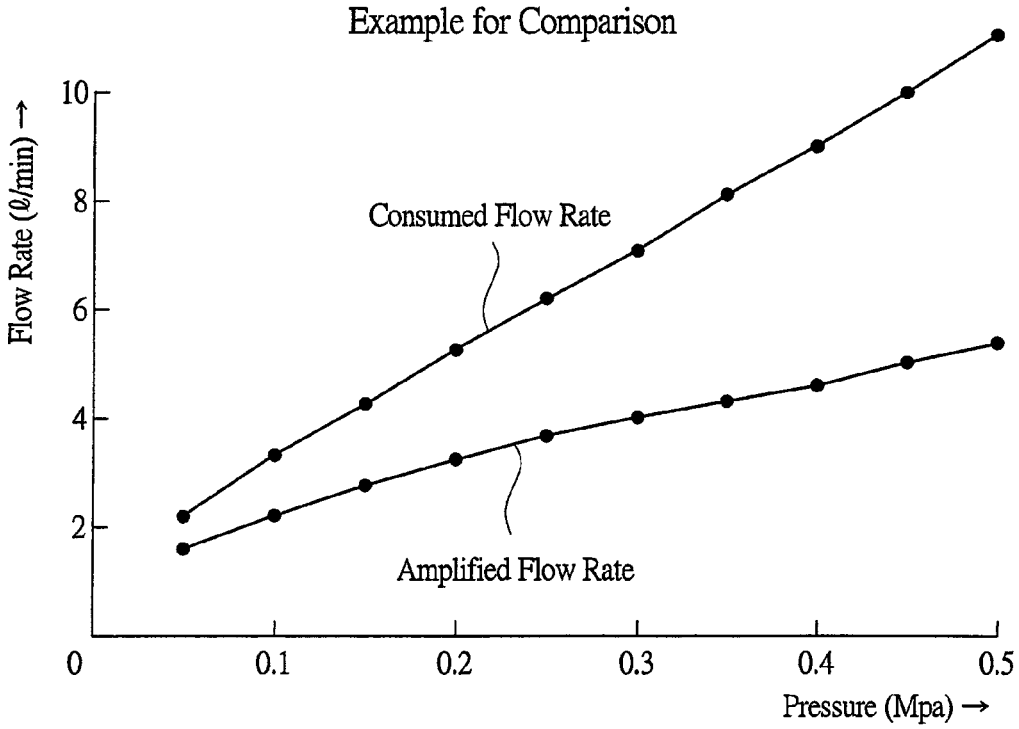
FIG. 10 is a flow rate diagram of the ion generator shown in FIG. 8 as an example for comparison.

FIG. 9 is a flow rate diagram in the present invention, showing a flow rate of air ejected from the ejection hole 19 in case where compressed air is supplied from the air supply path 11 to the ion generator 10*c* shown in FIG. 7. On the other hand, FIG. 10 is a flow rate diagram in an example for comparison in case where compressed air is supplied to the ion generator 10*d* shown in FIG. 8 as an example for comparison. These flow rate properties show measurements which are obtained by a flow meter as consumed flow rate of compressed air to be supplied to the air supply path 11 and amplified flow rate of suctioned air flowing through the inside of the pipe connected to the air introduction port 33. The horizontal axis indicates pressure of compressed air to be supplied to the air supply path 11. In each measurement, each ejection port 27 has an inner diameter of 0.3 mm, and two air guide holes 26 are formed in the nozzle 14.

Figure 11:
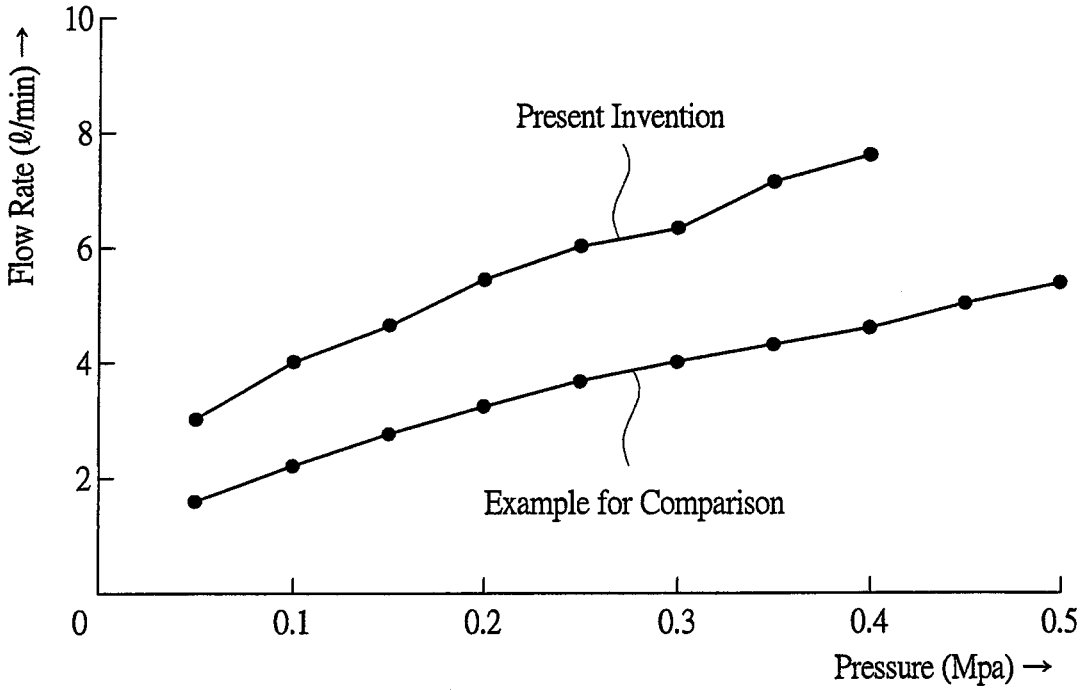
FIG. 11 is a flow rate diagram showing a comparison between an amplified flow rate of the ion generator shown in FIG. 7 and an amplified flow rate of the ion generator shown in FIG. 8 as an example for comparison.

As shown in FIG. 9, in the ion generator 10*c* according to the present invention in which the ejection ports 27 of the air guide holes 26 are open on the tapered surface 25, when supply flow rate, that is, consumed flow rate of the compressed air is increased, up to approximately 0.25 MPa, the amplified flow rate is larger than the consumed flow rate. When the consumed flow rate is increased in excess of the value, the amplified flow rate tends to be decreased. However, compared with the flow rate characteristics in the ion generator 10*d* shown in FIG. 10 as an example for comparison, significant flow rate increase characteristics have been found. FIG. 11 is a flow rate diagram showing a comparison between an amplified flow rate of the ion generator 10*c* shown in FIG. 9 and an amplified flow rate of the ion generator shown in FIG. 10*d* as an example for comparison, and the amplified flow rate of the ion generator 10*d* shown in FIG. 10 as an example for comparison are compared with each other.

In the ion generator 10*d* shown in FIG. 8 as an example for comparison, since the ejection ports 27 are open on the exposure surface 24 extending in the radial direction, the outside air involving effect due to ejected air is not sufficient. On the other hand, in the ion generator 10*a* to 10*c* according to the present invention, since the ejection ports 27 are open on the tapered surface 25 formed at the tip end of the nozzle 14, it was found that outside air surrounding the nozzle 14 in the air amplifying chamber 21 is involved in compressed air ejected from the ejection ports 27, so a large amount of air can be ejected from the ejection hole 19. Therefore, it is possible to spray a large amount of air ions to the object without increasing the flow rate of compressed air to be supplied from the supply source to the air supply path 11, and to enhance the static elimination effect.

The present invention is not limited to the above described embodiments, and various modifications can be made within the range not deviating from the gist of the invention. For example, an insulating sleeve made of ceramic or the like may be mounted on an inner surface of the ejection hole 19 of the ejection head 18 as an opposite electrode.

INDUSTRIAL APPLICABILITY

The ion generator according to the present invention is applicable for the elimination of static electricity of electronic components and others in a manufacturing line for manufacturing and assembling the electronic components.

What is claimed is:

1. An ion generator having a discharge electrode and an opposite electrode provided in the vicinity of the discharge electrode, and generating air ions by applying an alternating high voltage between the electrodes to generate corona discharge, wherein the ion generator has a nozzle supporting the discharge electrode, the nozzle being formed with an exposure surface for exposing a tip end portion of the discharge electrode, and a tapered surface extending to an outer peripheral surface from the exposure surface so as to be slanted in a base end portion side direction, the nozzle is formed with an air guide hole communicating with the air supply path, and an ejection port of the air guide hole is formed so as to be open on the tapered surface, outside air surrounding the nozzle is involved in air which flows along the tapered surface from the ejection port and flows in a front direction of the discharge electrode.

2. The ion generator according to claim 1, wherein an auxiliary air guide hole is formed in the nozzle, wherein air is supplied to the periphery of the discharge electrode from the auxiliary air guide hole.

3. The ion generator according to claim 1, which has an ejection head which covers the nozzle, the ejection head being formed with an ejection hole for ejecting air ions and an air introduction hole through which outside air is taken in.

4. The ion generator according to claim 3, wherein the ejection head is made of conductive material, wherein the ejection head is defined as the opposite electrode.

5. The ion generator according to claim 3, wherein an air supply joint member formed with an air introduction port communicating with the air introduction hole is mounted on the ejection head, wherein the outside air is supplied to the periphery of the nozzle from the air introduction port.

6. The ion generator according to claim 1, wherein the tip end portion of the discharge electrode is approximately on the same level with the exposure surface.

7. The ion generator according to claim 1, wherein the tip end portion of the discharge electrode protrudes in comparison with the exposure surface.

8. The ion generator according to claim 2, which has an ejection head which covers the nozzle, the ejection head being formed with an ejection hole for ejecting air ions and an air introduction hole through which outside air is taken in.

9. The ion generator according to claim 2, wherein the tip end portion of the discharge electrode is approximately on the same level with the exposure surface.

10. The ion generator according to claim 2, wherein the tip end portion of the discharge electrode protrudes in comparison with the exposure surface.

11. The ion generator according to claim 3, wherein the tip end portion of the discharge electrode is approximately on the same level with the exposure surface.

12. The ion generator according to claim 3, wherein the tip end portion of the discharge electrode protrudes in comparison with the exposure surface.

13. The ion generator according to claim 4, wherein the tip end portion of the discharge electrode is approximately on the same level with the exposure surface.

14. The ion generator according to claim 4, wherein the tip end portion of the discharge electrode protrudes in comparison with the exposure surface.

15. The ion generator according to claim 5, wherein the tip end portion of the discharge electrode is approximately on the same level with the exposure surface.

16. The ion generator according to claim 5, wherein the tip end portion of the discharge electrode protrudes in comparison with the exposure surface.

17. The ion generator according to claim 8, wherein the tip end portion of the discharge electrode is approximately on the same level with the exposure surface.

18. The ion generator according to claim 8, wherein the tip end portion of the discharge electrode protrudes in comparison with the exposure surface.

* * * * *